US011577294B2

(12) United States Patent
Fortmeier et al.

(10) Patent No.: US 11,577,294 B2
(45) Date of Patent: Feb. 14, 2023

(54) U-O FORMING OF A COMPONENT CURVED ABOUT THREE SPATIAL AXES

(71) Applicant: BENTELER AUTOMOBILTECHNIK GMBH, Paderborn (DE)

(72) Inventors: Guenter Fortmeier, Dellbrueck (DE); Aloys Schroeder, Paderborn (DE); Matthias Koerner, Schloss Holte-Stukenbrock (DE); Eugen Seibel, Bad Lippspringe (DE); Thomas Henksmeier, Wadersloh (DE)

(73) Assignee: BENTELER AUTOMOBILTECHNIK GMBH, Paderborn (DE)

( * ) Notice: Subject to any disclaimer, the term of this patent is extended or adjusted under 35 U.S.C. 154(b) by 386 days.

(21) Appl. No.: 16/577,287

(22) Filed: Sep. 20, 2019

(65) Prior Publication Data

US 2020/0114408 A1 Apr. 16, 2020

(30) Foreign Application Priority Data

Sep. 24, 2018 (DE) ..... 10 2018 123 456.2

(51) Int. Cl.
*B21D 7/06* (2006.01)
*B21D 5/01* (2006.01)

(52) U.S. Cl.
CPC *B21D 7/06* (2013.01); *B21D 5/01* (2013.01)

(58) Field of Classification Search
CPC ..... B21D 5/01; B21D 7/06; B21D 11/203; B21C 37/08
USPC ..... 72/389.1
See application file for complete search history.

(56) References Cited

U.S. PATENT DOCUMENTS

| | | | | |
|---|---|---|---|---|
| 8,276,428 | B2 * | 10/2012 | Bruggenbrock | B21D 5/015 72/389.1 |
| 2013/0020834 | A1 * | 1/2013 | Diersmann | B21D 26/033 296/193.06 |
| 2014/0096579 | A1 | 4/2014 | Flehmig et al. | |
| 2015/0273563 | A1 | 10/2015 | Miyagi et al. | |
| 2017/0232492 | A1 * | 8/2017 | Isogai | B21C 37/08 138/171 |

FOREIGN PATENT DOCUMENTS

| | | | |
|---|---|---|---|
| CA | 2962236 | A1 | 4/2016 |
| CN | 104684661 | A | 6/2015 |
| EP | 2720813 | A1 | 4/2014 |
| EP | 2902128 | A1 | 8/2015 |
| EP | 3363663 | A1 | 8/2018 |

(Continued)

OTHER PUBLICATIONS

Extended European Search Report for European Application No. 19198564.7 dated May 26, 2020; 16pp.

(Continued)

*Primary Examiner* — Shelley M Self
*Assistant Examiner* — Smith Oberto Bapthelus
(74) *Attorney, Agent, or Firm* — Hauptman Ham, LLP

(57) ABSTRACT

The present disclosure relates to a method for producing a shaped sheet metal component from a billet by means of U O forming, wherein firstly a preform is created by the U-forming and then a final shaping is performed by the O forming to give a final form.

1 Claim, 15 Drawing Sheets

(56) References Cited

FOREIGN PATENT DOCUMENTS

| | | | | |
|---|---|---|---|---|
| JP | S57165120 | | * | 9/1982 |
| JP | S57165120 | A | | 12/1982 |
| JP | H03291115 | A | | 12/1991 |
| JP | H0763758 | | * | 7/1995 |
| JP | H07063758 | B2 | | 7/1995 |
| JP | 2016059938 | A | | 4/2016 |
| KR | 20120133191 | A | | 12/2012 |

OTHER PUBLICATIONS

Office Action for Chinese Application No. 201910889579.4 dated Dec. 24, 2020; 19pp.
Office Action for Chinese Application No. 201910889579.4 dated Oct. 21, 2021; 12pp.

* cited by examiner

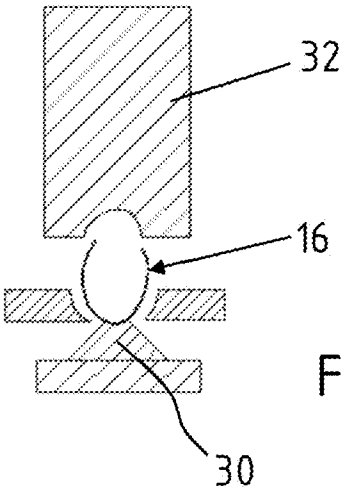
Fig. 13
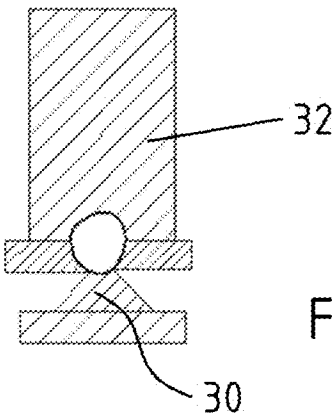
Fig. 14
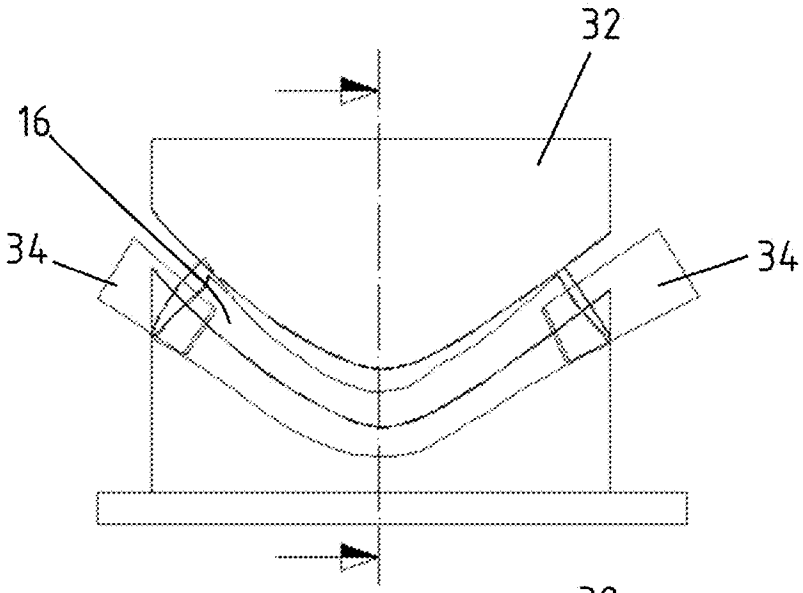
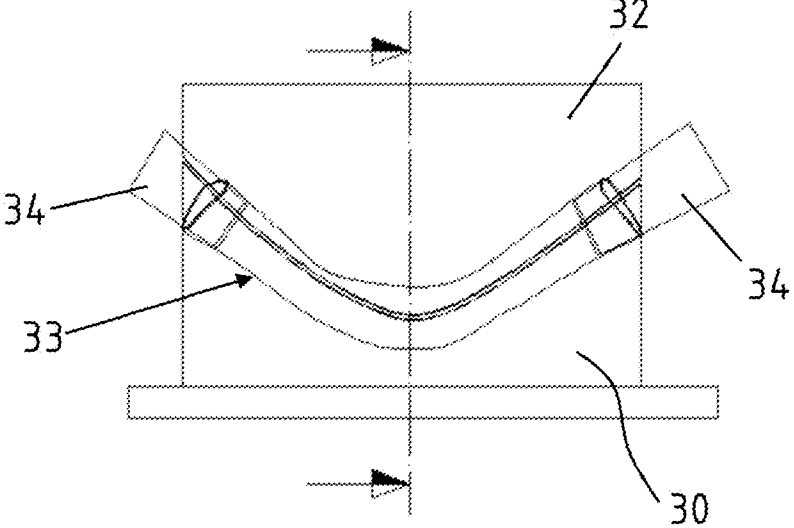

U-O FORMING OF A COMPONENT CURVED ABOUT THREE SPATIAL AXES

RELATED APPLICATIONS

The present application claims priority of German Application Number 10 2018 123 456.2 filed Sep. 24, 2018, the disclosure of which is hereby incorporated by reference herein in its entirety.

FIELD

The present application relates to a method for producing a shaped sheet metal component from a billet by means of U-O forming.

BACKGROUND

It is known from the prior art to produce sheet metal components by shaping. For this purpose, a metal billet is provided and is shaped in a shaping tool so as to form a shaped sheet metal component. This shaped sheet metal component has a three-dimensional contour. This shaping usually takes place by means of a press-shaping tool, that is to say between a top tool and a bottom tool.

Presently, U-O forming is known from the prior art if the intention is to produce a hollow profile having a closed cross section. For this purpose, firstly a planar billet is provided, said planar billet is pre-formed into a U-shape and then shaped into an O-shape, in order to exhibit a profile having a closed cross section.

For example, CA 2,962,236 A1 discloses such a production method.

SUMMARY

It is an object of the present disclosure, proceeding from the prior art, to improve the shaping possibilities for a component curved about at least two spatial axes and produced by a U-O form.

The above-mentioned object is achieved according to the disclosure.

The method for producing a shaped sheet metal component from a billet by means of U-O forming in this case provides that firstly a preform is created by the U-forming and then a final shaping is carried out by the O-forming. According to the disclosure, the method is characterized by the following method steps:

providing a planar billet,

U-forming the billet to give a U-preform, near-net-shape cutting of the U-preform, placing the U-preform into an intermediate forming tool and bending up the protruding legs, like the ends, of the U-form, a filling body being placed in the U-preform and the bending-up causing the legs to overlap the filling body in portions, and the filling body being pulled out of the preform after the bending-up, so as to generate elastic deformation of the bent-up ends, O-forming the intermediate form produced in this way.

Alternatively or in addition, the method for producing a shaped sheet metal component from a billet by means of U-O forming is carried out using the following method steps:

providing a planar billet, shaping the billet on a shaping tool with a curvature about a first spatial axis, driving a shaping press into the billet that has been shaped with the first curvature, the shaping press creating a second curvature of the billet about a second spatial axis, which is substantially orthogonal with respect to the first spatial axis and simultaneously producing a third curvature about a third spatial axis, the third spatial axis being substantially orthogonal with respect to the first spatial axis and to the second spatial axis, said two method steps creating a U-preform, the driving-in of the shaping press creating the first curvature on the U-preform, O-forming the U-preform produced in this way.

According to the disclosure, it is thus possible to significantly increase the freedom for shaping by virtue of the intermediate forming step with the filling body. It is likewise possible to increase the freedom for shaping by creating a U-form or U-preform having at least three curvatures, each curved about one spatial axis, all three spatial axes being substantially perpendicular with respect to one another.

The two above-described methods may also be combined. In the context of the disclosure, this means that firstly the U-preform is created about three spatial axes, each having at least one curvature about one spatial axis in each case, and said U-preform is then provided with a near-net-shape cut and subsequently placed in an intermediate forming tool.

A development according to the disclosure provides that during O-forming of the U-form produced in this way, the U-form is laid on a component holder and mandrels are driven into at least one end side, or into the two end sides. The mandrels hold or fix the U-form on the component holder. Then, mold jaws are moved laterally onto the U-form. Concurrently and/or consecutively, a die is lowered in the vertical direction. The lateral mold jaws and the top-side die then carry out an O-forming, at least in longitudinal sections, over the complete cross-sectional length, so as to create a closed hollow profile in cross section. In this way, it is possible to combine two operations in one operation and/or in one tool. This refers to the lateral bending-up or curling of the legs of the U-form by the mold jaws and to the curling of the ends and the resultant closing of the cross section of the hollow profile. The intermediate form mentioned further below, instead of the U-form, can also be further processed by the O-forming thus described.

The planar billet can have a homogeneous wall thickness but can also have wall thicknesses that differ from one another, for example in the form of a tailored blank.

Formation of the U-form causes a first curvature to be made in the cross section. The component is, however, likewise curved about a second spatial axis that runs substantially transversely with respect to the spatial axis of the U-form. Unintended indentations may thus occur as the O-forming begins, with the result that a concave bulge would arise on the O-form in a cross section. That is to say, a part bulges inward, which is however now avoided according to the disclosure by the intermediate forming.

The filling body is thus pulled out of the preform again on the intermediate forming tool. This creates an elastic deformation of the bent-up legs or the bent-up ends. This deformation can also be partially plastic. Use of the filling body ensures, however, that no inwardly directed bulge is created on the intermediate form.

In a further shaping step, the O-forming is then carried out, the face sides of the ends are placed against one another. Said face sides can also be longitudinal seam welded, for example. An internal high-pressure shaping process may still follow the O-forming.

It has been found according to the disclosure that the O-forming is carried out in two steps, firstly the bent-up ends being freely bent further inward and then the face sides of the ends coming together in a further method step.

A press-shaping tool having a closed mold cavity in cross section in the closed state is used when the face sides come into contact with one another.

For this purpose, the intermediate form has a maximum width that is narrower than the width of the mold cavity itself when said intermediate form is placed into the O-forming tool. During the O-forming, the intermediate form is thus flattened in terms of its height which causes an increase in the width, with the result that, with the mold cavity closed, the shaped sheet metal component produced by O-forming bears against the mold cavity of the O-forming tool on all sides.

Furthermore, according to the disclosure, the preform or the intermediate form can be produced with a cross section that varies in the longitudinal direction and/or with a varying wall thickness. Specifically as a result of the degrees of freedom of shaping being increased by the intermediate forming, cross sections that vary can also be produced over the length of the component.

Billets having different wall thickness, so-called tailored blanks, can likewise be processed.

In a further embodiment, the O-forming is carried out as hot-forming, with subsequent press quenching, with the result that a high tensile strength of more than 1000 MPa can be set for a quenchable steel alloy.

BRIEF DESCRIPTION OF THE DRAWINGS

Further advantages, features, properties and aspects of the present disclosure form the subject matter of the following description. Embodiments are illustrated in the schematic figures. These serve as an aid to understanding the embodiments. In the figures:

FIGS. 11 to 14 show an alternative embodiment of the method with respect to the O-forming.

In the figures, the same reference numerals are used for identical or similar components, even though a repeated description is omitted for reasons of simplification.

DETAILED DESCRIPTION

Figure 1A:
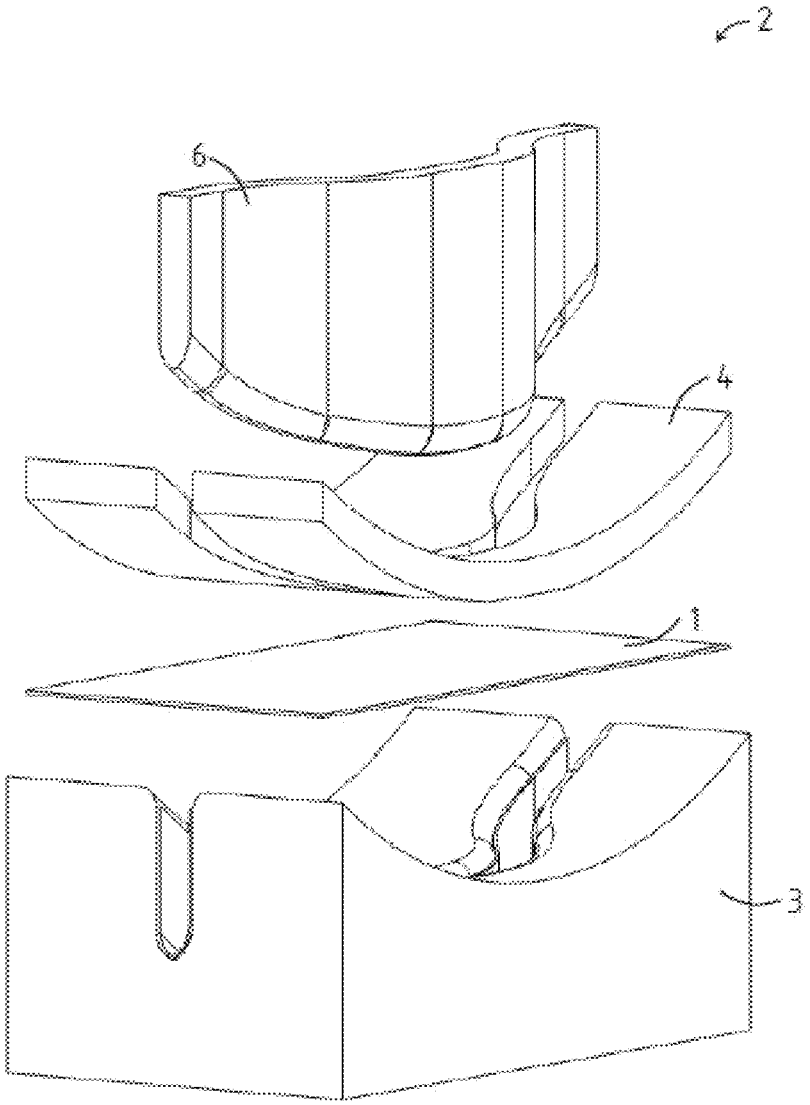
FIGS. 1A to 1D, 2, 3A-3C, 4, 5A-5B, and 6-10 show the various method steps for producing the component.
Figure 1B:
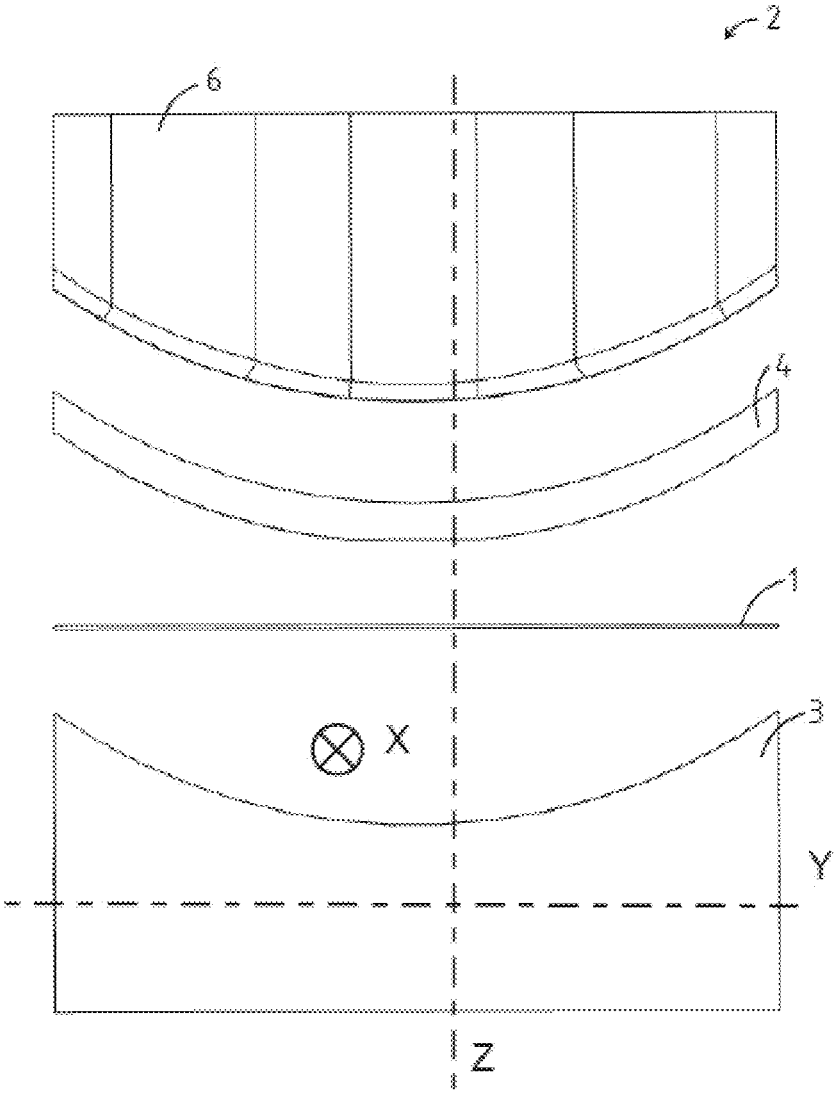
Figure 1C:
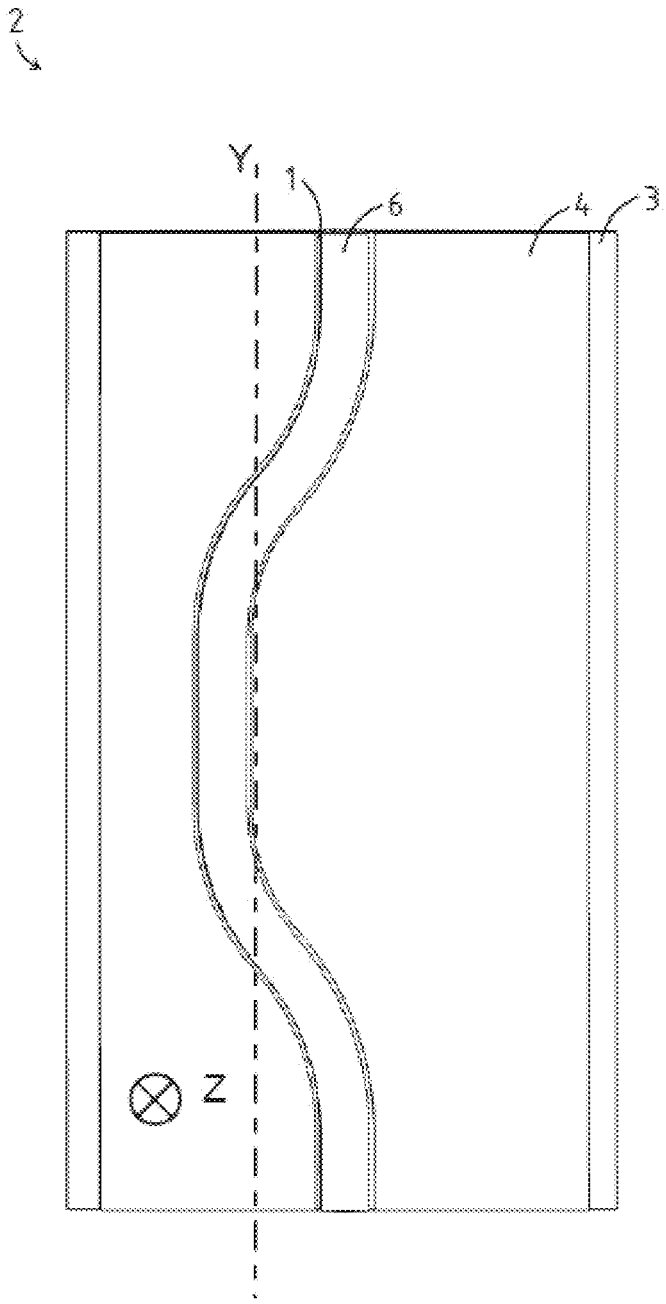
Figure 1D:
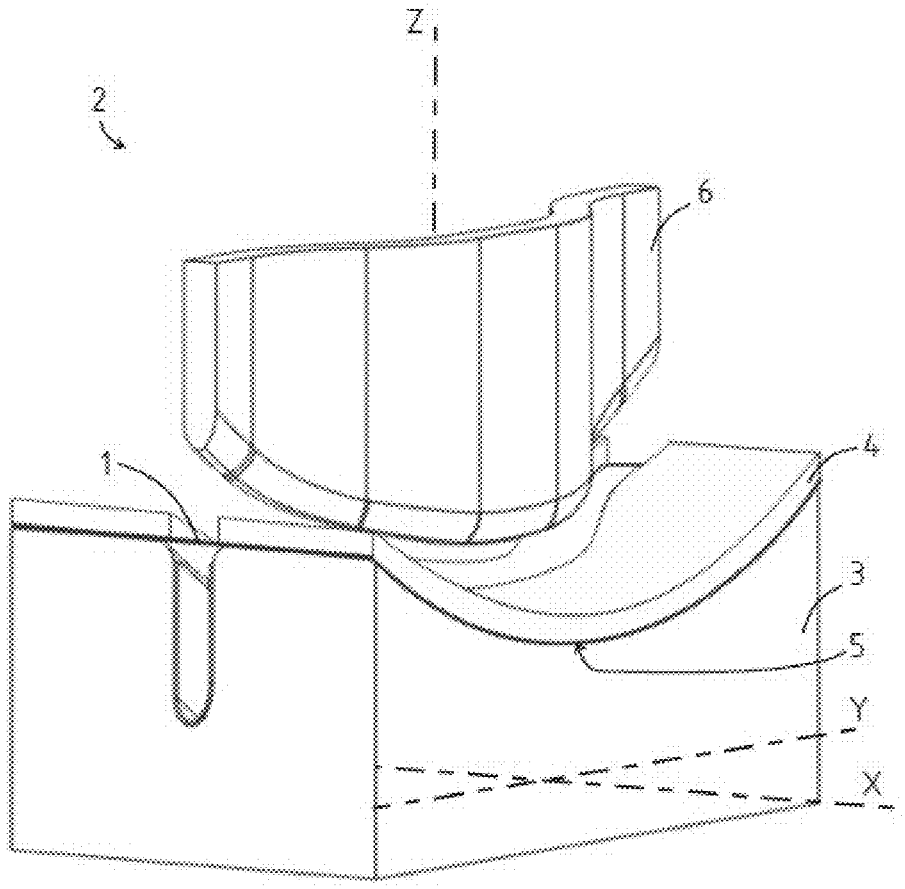

FIGS. 1A to 1D show a deep-drawing tool 2, in order to be formed from a planar metal billet 1 initially provided on a deep-drawing tool 2 for the purpose of U-forming and so as to form a preform. The billet 1 is placed into the deep-drawing tool 2 and a holding-down device 4 is lowered onto a die 3, illustrated in FIG. 1B. In so doing, a first curvature 5 is created about a spatial axis X, with the result that the billet 1 is preformed having an arc or a wave. Two or three curvatures could also be created so as to be offset in a manner parallel to one another about the first spatial axis X, for example in accordance with the principle of a wave profile.

Figure 2:
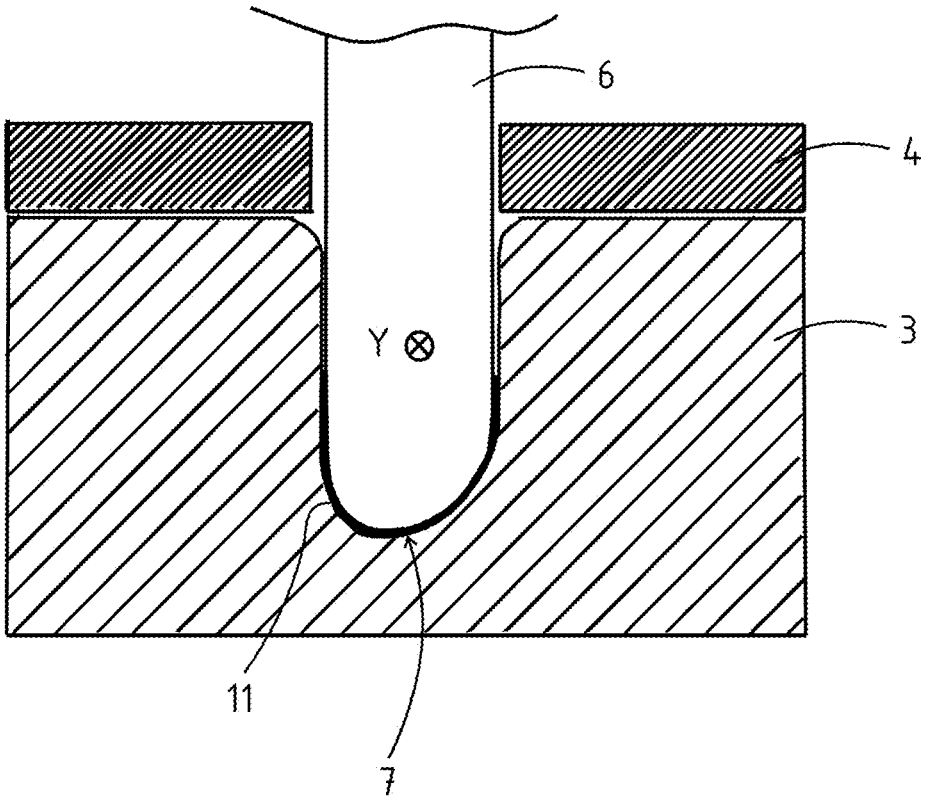

A shaping press 6 then moves into the deep-drawing tool 2 and creates a second curvature 7, illustrated in FIG. 2 about a second spatial axis Y. The press 6 is however also simultaneously curved in its longitudinal direction about a third spatial axis Z. This is evident in the plan view of FIG. 1C. The movement of the shaping press 6 into the billet 1 thus not only creates the second curvature 7 about the second spatial axis Y but also creates the first curvature 5 about the first spatial axis X on the U-preform 11, and also a third curvature 29 about a third spatial axis Z. A plurality of third curvatures can also be made, each about the spatial axis Z, with the result that a wave form is likewise created in the plan view in FIG. 1C and also discussed later in relation to the U-preform in the plan view in FIG. 3B.

The second spatial axis Y and the first spatial axis X and the third spatial axis Z extend transversely with respect to one another, however they need not intersect. The spatial axes X, Y and Z may, however, also be arranged in an angle range of 60 to 110 degrees, like 70 to 100 degrees, with respect to one another. The spatial axes need not intersect; they may extend so as to be offset with respect to one another. If both were to be projected into a plane, they would extend in the above-mentioned angle range or transversely with respect to one another.

Figure 3A:
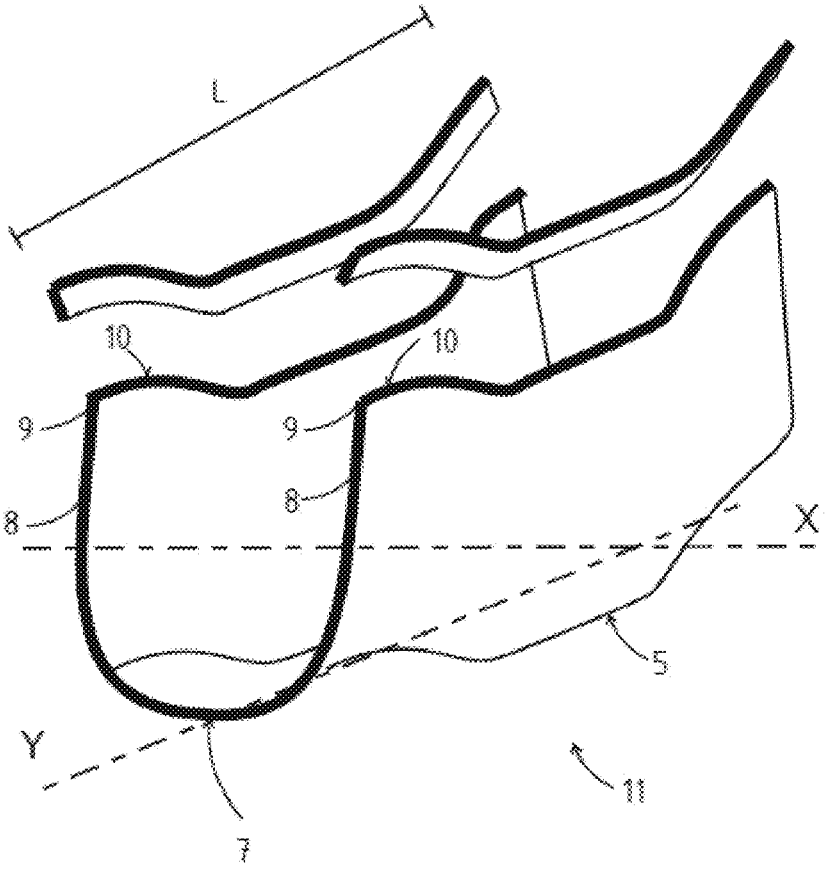
Figure 3B:
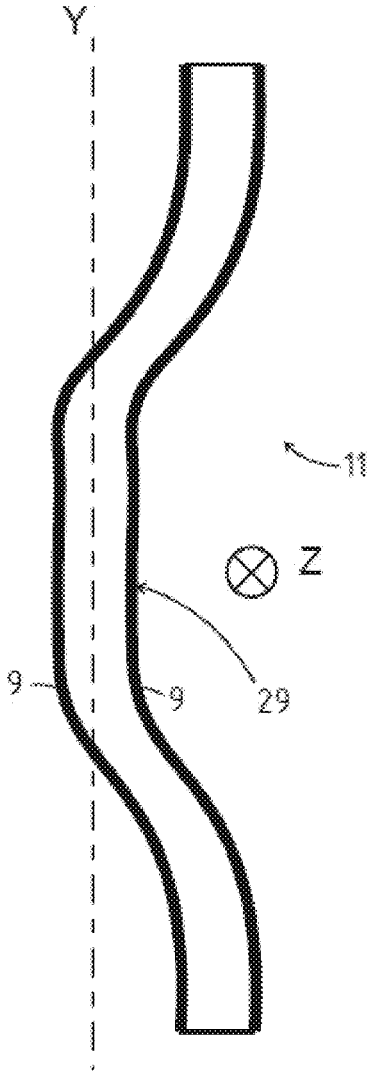
Figure 3C:
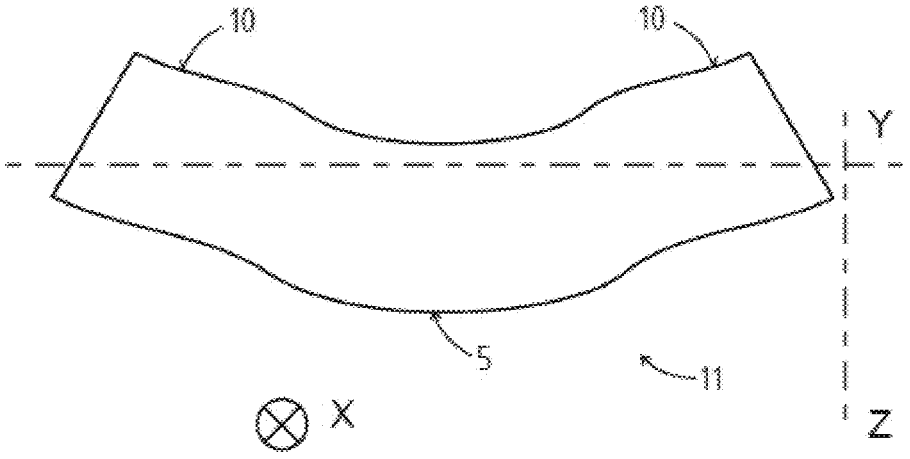
Figure 4:
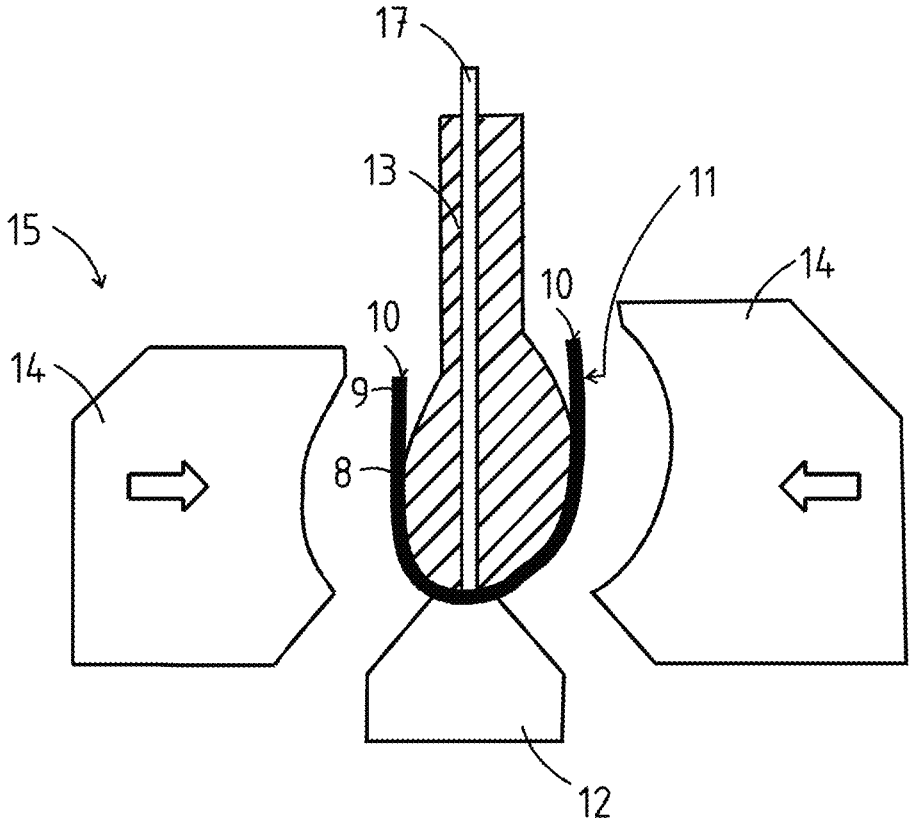
Figure 5A:
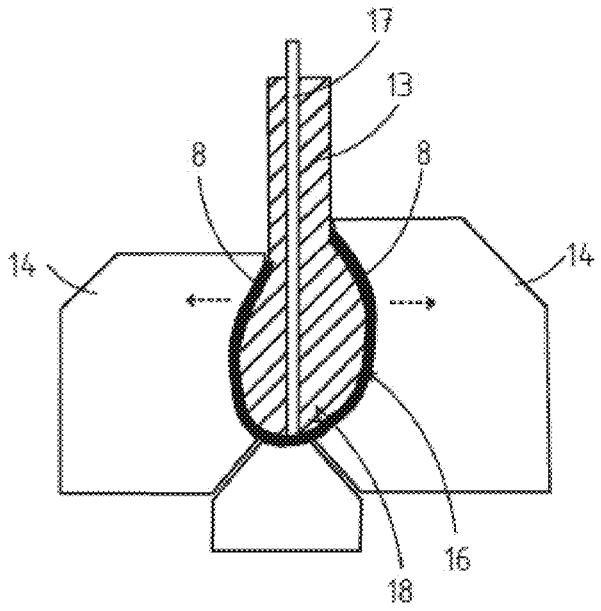
Figure 5B:
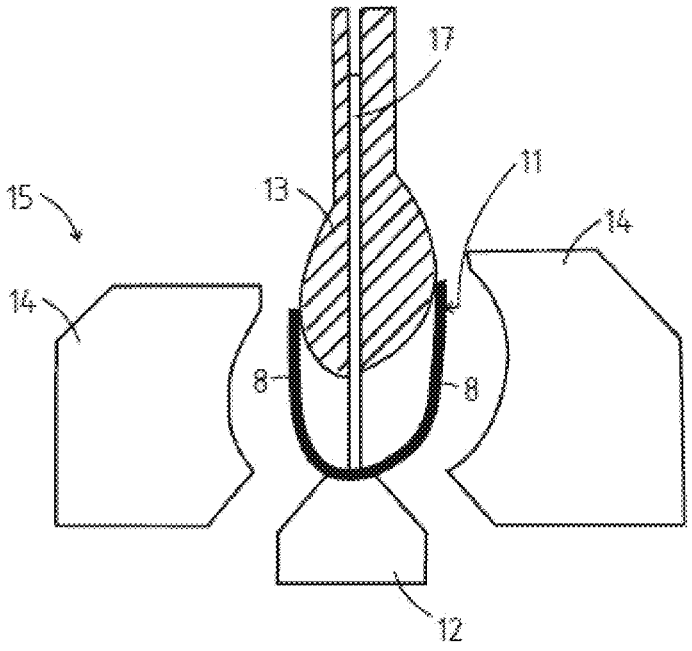

A U-preform 11 is therefore prepared having a first curvature 5 about a first spatial axis X and a second curvature 7 about a second spatial axis Y, and a third curvature 29 about a third spatial axis Z, in accordance with FIGS. 3A to 3C. For the sake of clarity, here the second spatial axis Y is represented in a manner following the curvature 5 about the first spatial axis X. The U-preform 11 has a U-shape, each of the legs 8 of which is cut at ends 9. This cut is a near-net-shape cut. Face sides 10 are thus produced at the ends 9. The face sides 10 extend over the length L of the U-preform 11. The intermediate forming according to the disclosure now takes place, as illustrated in FIGS. 5, 5A, and 5B.

The U-preform 11 is set down on an anvil 12 and a filling body 13 is introduced into the preform 11. Further tool parts 14 of an intermediate forming tool 15 are then used to bend up the legs 8, in the end region 9 thereof. This takes place such that the ends 9 of the legs 8 are bent up pointing toward one another. Said ends 9 thus overlap the filling body 13 at least in portions, as illustrated in FIG. 5A. The tool parts 14 are then opened, as indicated by the dashed arrows. In order that the filling body 13 can now be pulled out of the intermediate form 16 produced in this way, at least one pin 17 is provided and engages through the filling body 13 and presses against the base 18 of the intermediate form 16, with the result that when the filling body is pulled out, the legs 8 are elastically outwardly deformed, as illustrated in FIG. 5B. Additionally, a slight plastic deformation of the legs 8 can also take place here.

Figure 6:
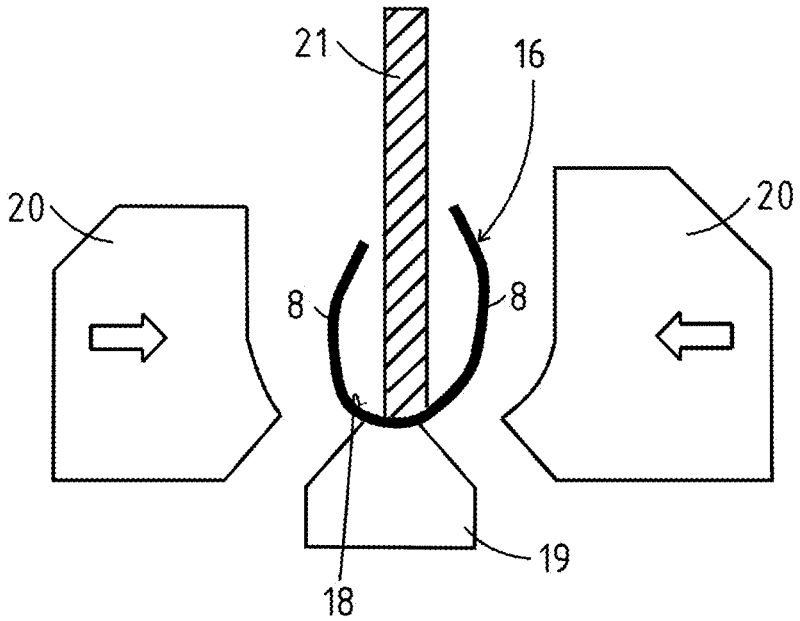
Figure 7:
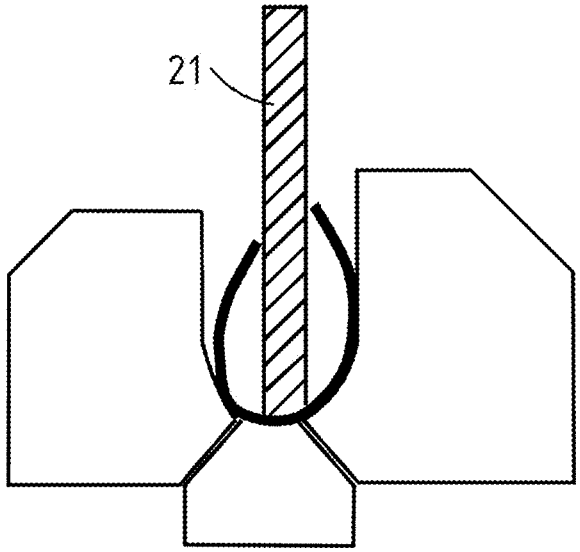
Figure 8:
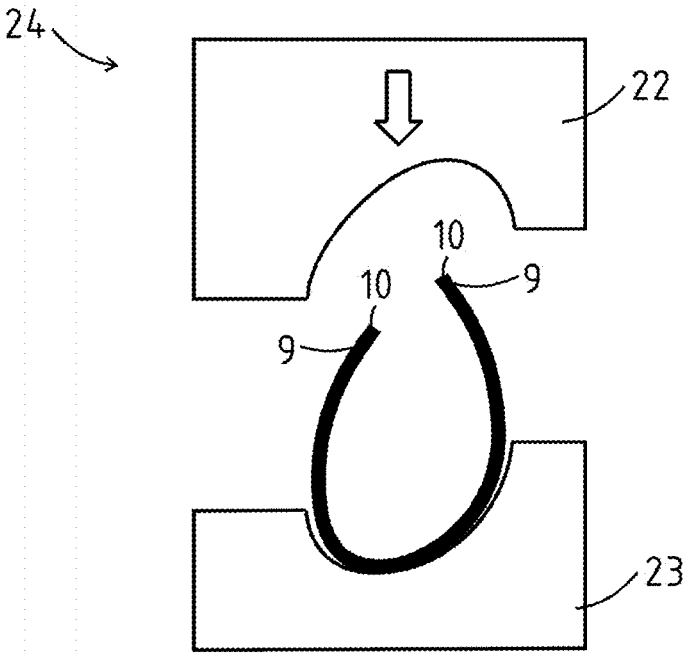

An O-forming then follows said intermediate forming step, in two further method steps. Firstly, the intermediate form 16 produced in this way is in turn set down on another anvil 19, and the legs 8, the ends 9 of the legs 8, are bent further inward with tool parts 20 of an O-forming tool, as illustrated in FIG. 7. A holding pin 21 is provided here and presses the base 18 of the intermediate form against the anvil 19, with the result that the legs 8 are bent further toward one another, as illustrated in FIGS. 6 and 7.

Figure 9:
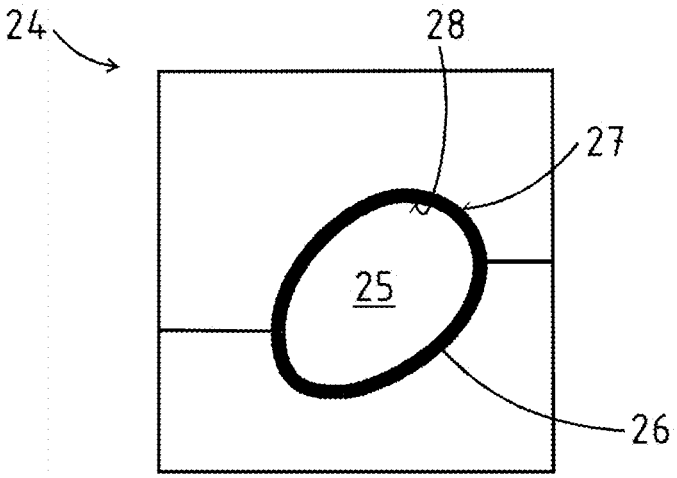
Figure 10:
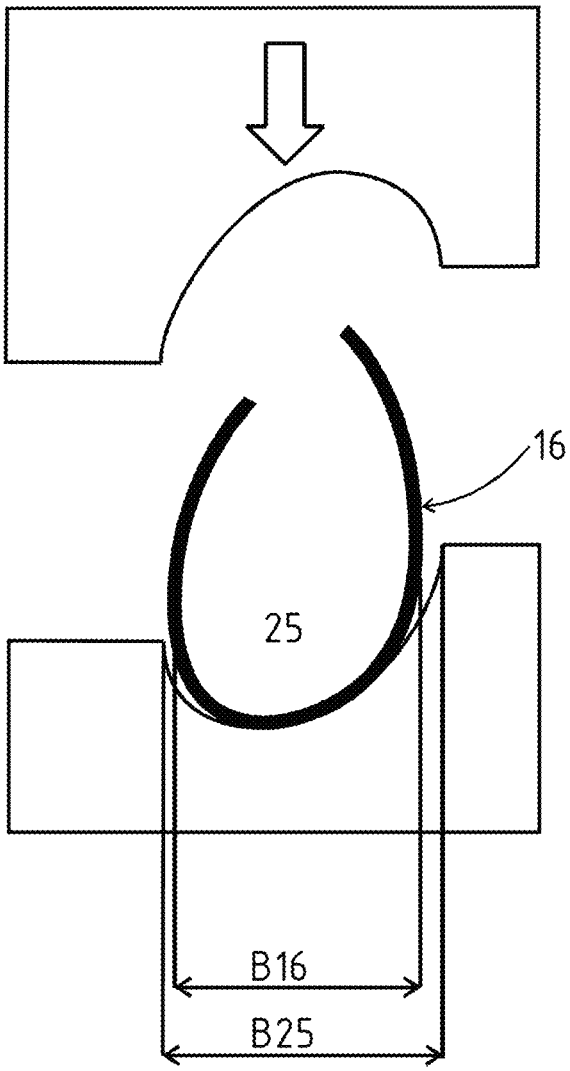

In a further, subsequent method step of the O-forming, a press-shaping tool 24 having a top tool 22 and a bottom tool 23 is then used. A mold cavity 25, according to FIG. 10, has a width B25 that is wider than a width B16 of the intermediate form 16 after the first method step of the O-forming (c.f. FIG. 10). The press-shaping tool 24 is then closed, as illustrated in FIG. 9. This results in a closed mold cavity. The face sides of the ends are placed against one another and a transformed sheet metal molding 26, also referred to as a shaped component, of closed cross section is produced. The outer lateral surface 27 of said transformed sheet metal molding 26 bears extensively on the inner lateral surface 28 of the mold cavity 25 on all sides.

Figure 12:
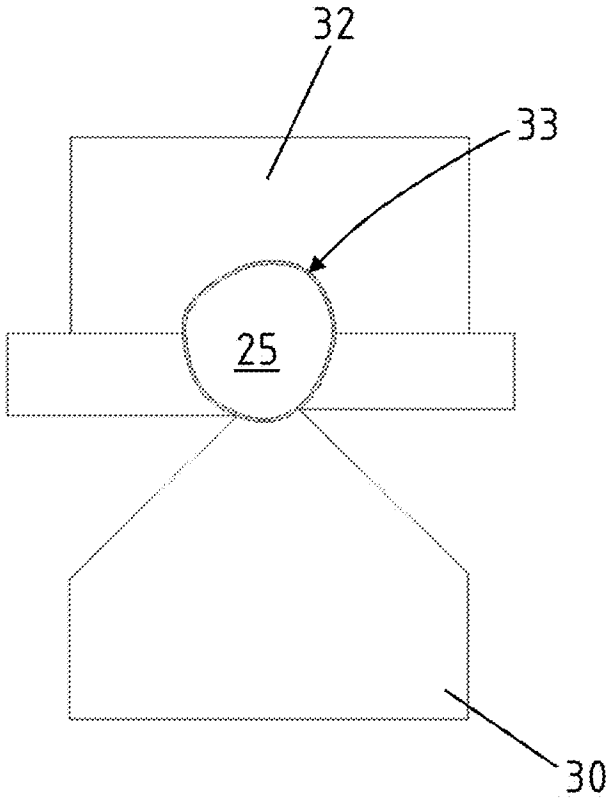
Figure 11:
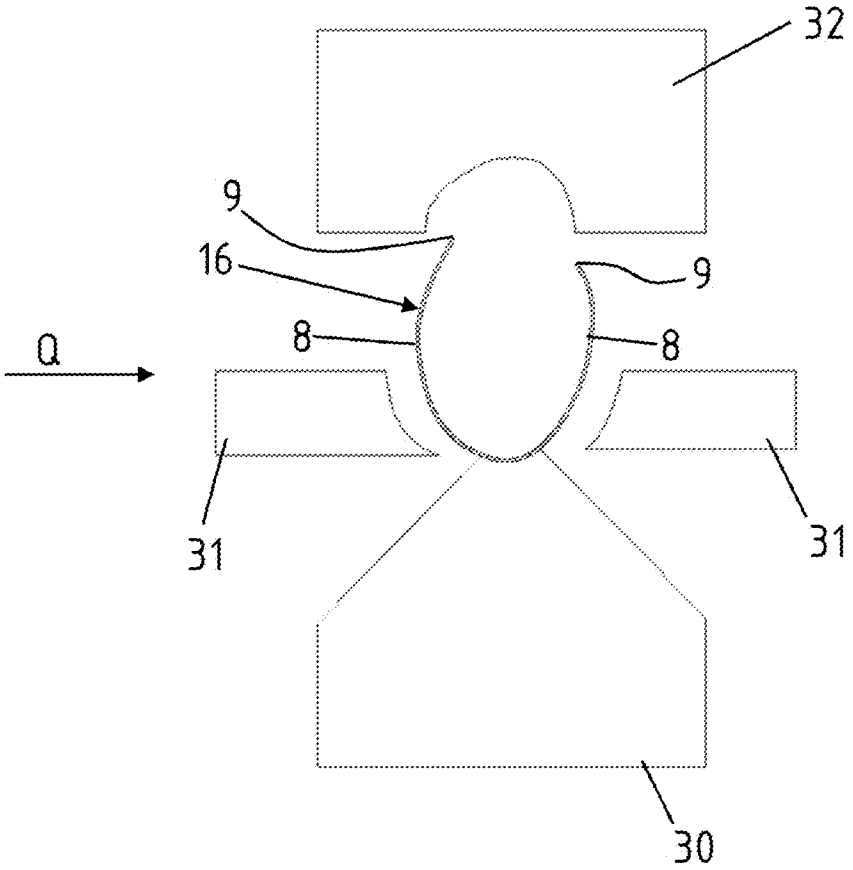

FIGS. 11, 12, 13 and 14 show an alternative embodiment of the method according to the disclosure with respect to the O-forming. FIGS. 11 and 12 show a cross section through the same tool at different points in time. FIGS. 13 and 14 show a respective side view and cross-sectional view of the same tool at different points in time. In accordance with FIGS. 11 and 13, the initially produced U-form or intermediate form is set down on a component holder 30. The U-form may be a U-form produced by U-forming or the U-preform produced according to the disclosure. Said U-form may however also be the intermediate form 16 that was produced with the manufacturing step in FIG. 5B. In the case of this intermediate form 16, in a modification with respect to FIGS. 6 to 9, one tool is then used for further O-forming. Here, firstly the legs 8 are bent toward one another in a transverse direction Q by lateral mold jaws 31. Consecutively or concurrently, an upper die 32 begins to be lowered, with the result that the ends 9 of the legs 8 are formed toward one another and thereby the O-forming, that is to say the production of a hollow profile having a closed cross section, is produced. This shaping process is completed in FIGS. 12 and 14, which illustrate the shaped sheet metal component 33 produced. Mandrels 34 are driven into the end sides, so as to prevent the intermediate form or U-form from tilting after being set down on the component holder 30. This driving-in of the mandrels 34 takes place for part of the length portion in the longitudinal direction of the intermediate form 16. In this way, the intermediate form 16 is fixed during the shaping process and held against tilting or other slipping on the component holder 30. After completion of the O-forming process illustrated in FIG. 14, the mandrels 34 are then pulled out laterally from or from the end sides of the shaped sheet metal component 33 produced, obliquely upward to the left and obliquely upward to the right in the figure (not illustrated in greater detail).

The foregoing description of some embodiments of the disclosure has been presented for purposes of illustration and description. It is not intended to be exhaustive or to limit the disclosure to the precise form disclosed, and modifications and variations are possible in light of the above teachings. The specifically described embodiments explain the principles and practical applications to enable one ordinarily skilled in the art to utilize various embodiments and with various modifications as are suited to the particular use contemplated. It should be understood that various changes, substitutions and alterations can be made hereto without departing from the spirit and scope of the disclosure.

The invention claimed is:

1. A process of producing a shaped sheet metal component from a billet by U-O forming, the process comprising:

providing a planar billet, shaping the billet on a shaping tool with a first curvature about a first spatial axis, driving a shaping press into the billet that has been shaped with the first curvature, the shaping press creating a second curvature of the billet about a second spatial axis, which is substantially orthogonal with respect to the first spatial axis, and simultaneously producing a third curvature about a third spatial axis, the third spatial axis being substantially orthogonal with respect to the first spatial axis and to the second spatial axis, wherein said shaping and driving create a U-preform, the driving-in of the shaping press creating the first curvature on the U-preform, inserting a filling body into the U-preform, and removing the filling body from the U-preform in a perpendicular direction relative to a longitudinal direction of the U-preform, and the removing of the filling body elastically deforming the U-preform.

* * * * *